US005094644A

United States Patent [19]

Kelley

[11] Patent Number: 5,094,644

[45] Date of Patent: Mar. 10, 1992

[54] DOLL HAVING DELAYED WETTING AND CRYING ACTION

[75] Inventor: William J. Kelley, Torrance, Calif.

[73] Assignee: Mattel, Inc., El Segundo, Calif.

[21] Appl. No.: 654,718

[22] Filed: Feb. 12, 1991

[51] Int. Cl.[5] ..... A63H 3/24; A63H 13/02; G08B 21/00; H01H 35/40

[52] U.S. Cl. ..... 446/305; 446/296; 446/297; 340/614; 200/83 B

[58] Field of Search ..... 446/305, 304, 302, 299, 446/298, 297, 296, 295, 267, 74; 340/614, 618; 200/81 H, 83 B, 83 N

[56] References Cited

U.S. PATENT DOCUMENTS

| | | | |
|---|---|---|---|
| 1,684,530 | 9/1928 | Bast | 200/83 B X |
| 2,196,912 | 4/1940 | Gilbraith | 446/305 |
| 2,538,845 | 1/1951 | Rashleigh et al. | 446/305 |
| 2,653,411 | 9/1953 | Beltz | 446/305 X |
| 2,689,430 | 9/1954 | Freeland | 446/305 X |
| 2,907,139 | 10/1959 | Rekettye | 446/305 |
| 2,934,857 | 5/1960 | Birnbaum | 446/305 |
| 2,978,833 | 4/1961 | Tancredi | 446/305 |
| 3,302,269 | 2/1967 | Cooper et al. | 200/83 B X |
| 3,775,901 | 12/1973 | Ellman et al. | 446/305 X |
| 3,839,819 | 10/1974 | Hollingsworth et al. | 446/305 |
| 3,959,919 | 6/1976 | Baulard-Cogan | 446/305 |
| 3,992,706 | 11/1976 | Tunney et al. | 340/618 |
| 4,115,948 | 9/1978 | Burks | 446/305 |
| 4,151,675 | 5/1979 | Juan | 446/305 |
| 4,160,338 | 7/1979 | Lyons et al. | 446/305 X |
| 4,224,610 | 9/1980 | Quinby | 340/614 |
| 4,347,683 | 9/1982 | Maxim | 446/267 |
| 4,356,663 | 11/1982 | Terzian | 446/305 X |
| 4,365,124 | 12/1982 | Robinson | 200/81 H X |
| 4,415,886 | 11/1983 | Kyogoku et al. | 340/618 |
| 4,965,415 | 10/1990 | Young et al. | 200/83 N |

FOREIGN PATENT DOCUMENTS

| | | | |
|---|---|---|---|
| 588684 | 12/1959 | Canada | 446/305 |
| 2704412 | 3/1977 | Fed. Rep. of Germany | 446/305 |
| 8901812 | 3/1989 | PCT Int'l Appl. | 446/304 |
| 2230200 | 10/1990 | United Kingdom | 446/305 |

*Primary Examiner*—David N. Muir
*Attorney, Agent, or Firm*—Roy A. Ekstrand

[57] ABSTRACT

A doll includes a hollow head and torso and generally replicates a human infant in appearance. The head portion defines an orifice for the introduction of a liquid such as water through simulated nursing. The water is initially received within the doll interior in a first reservoir which is effectively isolated from a second reservoir within the doll torso by a siphon tube coupling. The siphon tube coupling serves to delay the transfer of liquid from the first reservoir to the second reservoir until a predetermined amount of liquid has been introduced. The second reservoir includes a flexible wall portion which bulges outwardly when filled with water to trigger a switch which enables an internally supported sound generating system to produce crying action. In an alternate embodiment, the first and second reservoirs are combined within a common water tank and interconnected by a siphon passage. In the alternate embodiment, the sound generator is enabled by a pair of electrical contacts positioned within the siphon passage.

12 Claims, 2 Drawing Sheets 106
107
91
84
83
6
90
122
85
81
82
130
94
131
86
102
101
111
123
105
92
93
132
115
116
100
110
121
114
112
120
124
99
96
98
89
97
95
6

122
80
81
82
94
103
102
104
100
115
116
120
124
123
96
89

DOLL HAVING DELAYED WETTING AND CRYING ACTION

FIELD OF THE INVENTION

This invention relates generally to dolls and particularly to those having a drinking and wetting feature.

BACKGROUND OF THE INVENTION

Dolls which replicate human infants are among the most popular types of dolls used to entertain and amuse children of a substantial age range. In addition to merely resembling human infants in their appearance, dolls have been provided which simulate a variety of human infant activities. For example, dolls have been created which, to some degree, mimic activity such as drinking from a bottle, sleeping, wetting diapers, crying, walking and speaking. Dolls which simulate the drinking and wetting activity are extremely popular and have been provided in a variety of structures. One of the primary goals in providing a doll having a wetting feature is to add authenticity and realism to such dolls.

U.S. Pat. No. 2,934,857 issued to Birnbaum sets forth a DOLL WITH ROTATABLE HEAD AND LIQUID RESERVOIR in which a doll includes a reservoir which is rotatably mounted within a doll body. The reservoir mounting is provided such that the reservoir will rotate with head rotation of the doll. Means are provided for receiving a liquid within a mouth aperture on the doll and for directing such received liquid to the reservoir. Discharged tubes are provided which are coupled to simulated tear ducts in the doll's eyes as well as a urinary simulation on the lower torso of the doll.

U.S. Pat. No. 4,356,663 issued to Terzian sets forth a CRYING DOLL which includes a hollow head and hollow body connected at the neck. The head portion includes a pair of eyes and mouth having apertures defined therein. A liquid bladder is mounted in the head and includes a flexible wall and conduits in communication with the eye apertures. Means are provided for forcing the liquid from the bladder through the conduits to the eyes and a sound generator is provided to replicate a crying sound.

U.S. Pat. No. 2,538,845 issued to Rashleigh, et al. sets forth a VOICE DEVICE FOR DRINKING-WETTING DOLLS includes a doll having a hollow body, a urinary orifice, and a mouth orifice further includes an elongated tube coupling the mouth orifice to the urinary orifice. A vibratable reed is positioned within the tube and vibrates as liquid is forced through the tube during a simulated feeding or nursing to produce a sound commensurate with feeding.

U.S. Pat. No. 2,653,411 issued to Beltz sets forth a DRINKING AND WETTING DOLL WITH SOUND EFFECTS in which a hollow doll includes a hollow head and torso. The head defines a mouth orifice and a reservoir is supported within the interior of the doll torso. A coupling tube extends from the mouth orifice to the reservoir. The reservoir includes discharge means for providing simulating wetting on the doll's part when filled with liquid and an associated sound effect device such as a vibrating reed which provides accompanying sound effects for the drinking and wetting process.

U.S. Pat. No. 4,160,338 issued to Lyons, et al. sets forth a SOUND EMITTING AND WETTING DOLL having a hollow head and body and a mouth opening. The doll is adapted to produce a burping sound when its back is patted and simultaneously to spit up a portion of the previously fed bottle through the mouth opening. A burping sound is produced by a bellows in the body portion of the doll and a head bellows provides sudden air flow which causes liquid to be emitted from the mouth to produce a spitting up effect.

U.S. Pat. No. 4,151,675 issued to Juan sets forth DOLLS THAT SIMULATE PHYSIOLOGICAL FUNCTIONS in which a doll includes a hollow head and hollow body as well as a mouth orifice. A liquid reservoir is coupled to the mouth orifice and is supported within the interior of the doll body. The reservoir is filled by placing a bottle in the mouth of the doll head and means are provided to simulate the urinary function.

U.S. Pat. No. 2,689,430 issued to Freeland sets forth a SOUNDING WETTING DOLL having a hollow torso and body. A mouth opening is coupled to a tube which extends into the body interior. A small opening in the lower part of the torso permits water within the doll interior to escape and simulate the act of wetting. A noise maker is coupled to the neck passage of the doll such that squeezing the flexible doll body produces sounds which simulate crying or burping in the doll.

U.S. Pat. No. 2,907,139 issued to Rekettye sets forth a WEEPING, CRYING AND WETTING DOLL in which a doll is provided with a hollow head and torso and a mouth opening as well as tear duct openings in the region of the doll's eyes. A coupling tube connects the doll's mouth opening to an interior reservoir which in turn is coupled to the interior of the doll body and the tear ducts surrounding the doll's eyes. A small opening in the lower torso of the doll body permits liquid to escape simulating a wetting function. A reservoir near the infant's eyes collects liquid to be discharged through the infant's tear ducts.

U.S. Pat. No. 2,978,833 sets issued to Tancredi sets forth a DRINKING, WETTING AND CRYING DOLL having a hollow head and torso. A mouth opening within the doll's head is coupled by a tube to a reservoir. When the doll is laid flat and liquid is "fed" to the doll through the mouth opening, the liquid collects in the interior reservoir within the head. Thereafter, when the doll is raised to a vertical position, a portion of the liquid flows from the reservoir to the doll body to be discharged as urinary function and a portion of the water also flows out through tear ducts in the doll's face to simulate crying.

U.S. Pat. No. 3,839,819 issued to Hollingsworth, et al. sets forth a CONTROLLED WETTING UNIT FOR DOLLS having a hollow head and body. A reservoir receives liquid introduced into the doll's mouth. A squeeze bulb and check valve are operative to control the flow of water from the reservoir to the simulated wetting orifice of the doll.

U.S. Pat. No. 3,959,919 issued to Baulard-Cogan sets forth ANIMATED OBJECTS SUCH AS DOLLS, FIGURED PERSONAGES AND THE LIKE in which a doll includes a hollow head and torso within which a pendulum weight is supported. A liquid reservoir within the interior of the doll torso comprises an expandable bladder which is acted upon by the pendulum weight to force quantities of liquid from the bladder through a wetting orifice in the lower torso of the doll.

U.S. Pat. No. 4,115,948 issued to Burks sets forth a DRINKING DOLL HAVING WETTING AND NONWETTING MODES having a mouth opening, a lower torso opening and an internal reservoir. A tube couples the mouth opening to the internal reservoir. Means are provided for alternatively collecting and retaining the received liquid within the reservoir or conducting it to the orifice in the lower torso to simulate wetting.

While the foregoing described prior art dolls have provided an increased play and activity value, they often lack realism of their simulated function and thus, there remains a need in the art for evermore realistic functioning dolls.

SUMMARY OF THE INVENTION

Accordingly, it is a general object of the present invention to provide an improved doll. It is a more particular object of the present invention to provide an improved doll which simulates the typical wetting and crying actions of a human infant.

In accordance with the present invention, there is provided a doll simulating wetting and crying actions comprises: a doll body having an interior cavity, a mouth opening, and a lower body opening; sound means for producing crying sounds; a first liquid receiving and retaining reservoir coupled to the mouth opening; a second liquid receiving and retaining reservoir coupled to the lower body opening; siphon means coupling the first and second reservoirs, the siphon means being inoperative until the liquid within the first reservoir exceeds a predetermined level; and switch means responsive to the transfer of liquid from the first reservoir to the second reservoir enabling the sound means.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
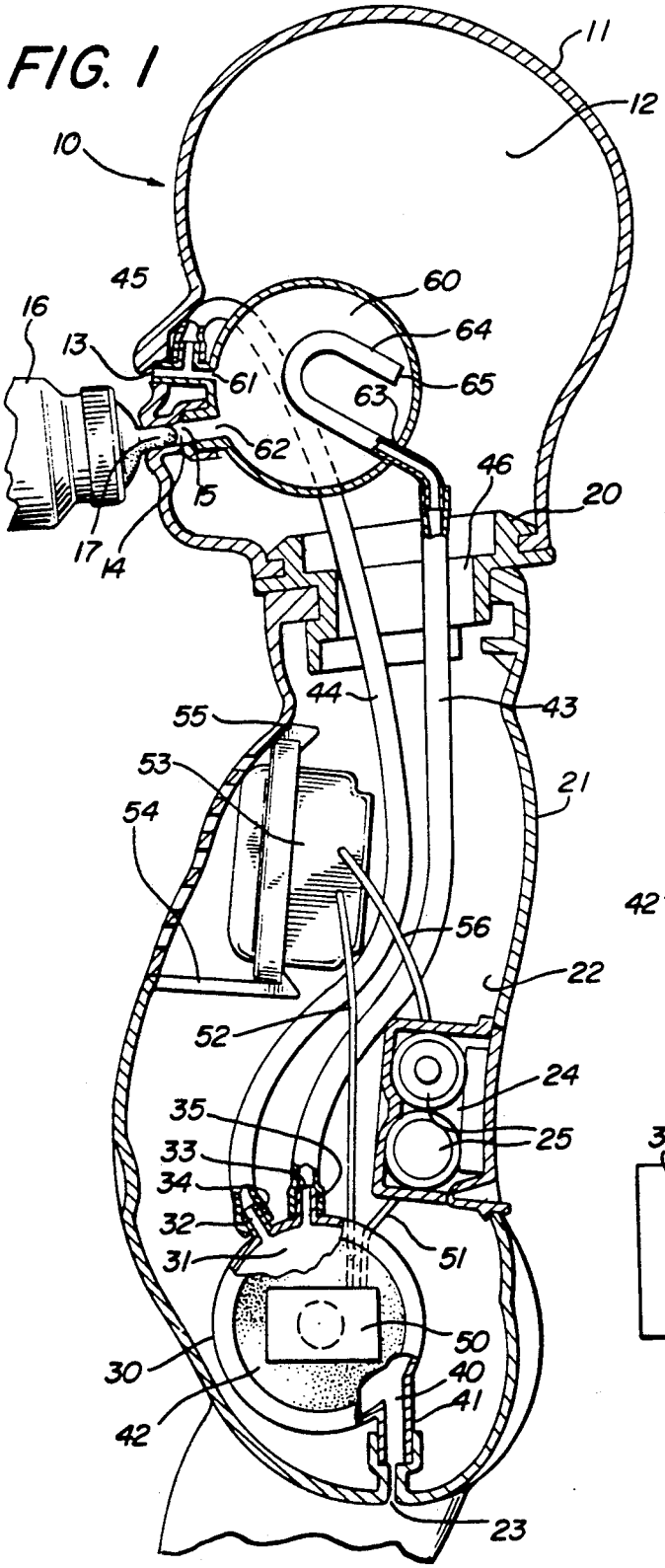
FIG. 1 sets forth a section view of a wetting and crying doll constructed in accordance with the present invention.

FIG. 1 sets forth a section view of a doll having delayed wetting and crying action constructed in accordance with the present invention and generally referenced by numeral 10. Doll 10 includes a head portion 11 defining an interior cavity 12 and a torso portion 21 defining an interior cavity 22. A neck coupler 20 defines an interior passage 46 and secures head 11 to torso 21. Head 11 is preferably formed of a flexible or semiflexible material and defines the general shape of contour of a human infant. Head 11 further defines an orifice 13 and a mouth orifice 15.

A hollow reservoir 60 is supported within interior cavity 12 by means not shown but in accordance with conventional fabrication techniques. Reservoir 60 includes an aperture 61 coupled to orifice 13 and to a vent aperture 45. Reservoir 60 further includes an aperture 62 coupled to mouth orifice and an aperture 63 defined in its outer wall. In accordance with the invention, a generally U-shaped siphon tube 64 is supported within reservoir 60 by means not shown but in accordance with conventional fabrication techniques. Siphon 64 extends outwardly from reservoir 60 through aperture 63 in a sealing attachment.

Torso 21 further defines a battery compartment 24 supporting a pair of conventional batteries 25. A conventional sound unit 53 is supported within interior cavity 22 by a pair of support brackets 54 and 55. An expandable reservoir 30 having a generally cylindrical shape is supported within interior cavity 22 near the lower portion of torso 21 by conventional support means not shown. Expandable reservoir 30 defines an interior cavity 31 having a pair of apertures 32 and 33 in the upper portion thereof. A pair of fittings 34 and 35 surround apertures 32 and 33. Expandable reservoir 30 further defines a downwardly facing outlet aperture 40 surrounded by a downwardly extending fitting 41. Torso 21 defines a downwardly facing orifice 23 which is coupled to fitting 41 of expandable reservoir 40. Orifice 23 is substantially smaller than outlet 40 and thus acts to restrict the flow of liquid from expandable reservoir 30 for reasons set forth below in greater detail. Expandable reservoir 40 further defines a flexible wall 42, the operation of which is better seen in FIG. 2. Suffice it to here, however, expandable wall 42 is generally planar when reservoir 30 is empty and convex or dome-shaped when reservoir 30 is filled. An electrical switch 50 is supported in contact with reservoir 30 by conventional support means within cavity 22 which, for purposes of illustration, are omitted from FIG. 1. Switch 50 is coupled by a wire 57 to batteries 25 and by a wire 52 to sound unit 53. A wire 56 couples sound unit 53 to batteries 25 to complete the electrical circuit thereof. A hollow tube 43 couples fitting 35 of reservoir 30 to siphon tube 64 while a second hollow tube 44 couples fitting 34 of reservoir 30 to vent opening 45 of reservoir 60.

In operation, with reservoirs 30 and 60 initially empty, flexible wall 42 of reservoir 30 is generally flat and switch 50 is maintained in its open circuit condition. As a result, sound unit 53 is not energized and doll 10 does not make any sound. In addition, due to the absence of liquid within reservoir 30, no liquid escapes through outlet 40 and orifice 23. Thus, doll 10 also does not produce a wetting action. As bottle 16 is coupled to mouth orifice 15 by nipple 17, the liquid (usually water) within bottle 16 flows through nipple 17 and mouth orifice 15 to begin filling reservoir 60. In most instances, doll 10 will be positioned in a generally horizontal or slightly inclined position during the simulated feeding process in which water flows from bottle 16 into reservoir 60. As liquid continues to flow into reservoir 60, air which would otherwise be trapped within reservoir 60 is vented out through aperture 61 and orifice 13. Because siphon tube 64 forms the only liquid coupling out of reservoir 60, the initial quantities of water within reservoir 60 are trapped therein and no outward flow occurs until the liquid level substantially covers siphon tube 64. Once sufficient liquid is present within reservoir 60 to initiate the siphoning action of siphon tube 64, water thereafter flows downwardly through siphon tube 64 and tube 43 into expandable reservoir 30. It should be noted that in accordance with an important aspect of the present invention, siphon tube 64 delays the transfer of liquid from reservoir 60 to expandable reservoir 30. This delay is not specifically a time delay but rather is a delay based upon the amount of water given to doll 10. Thus, the action of siphon tube 64 within reservoir 60 more realistically duplicates the activities of a human infant.

As water continues to flow from reservoir 60 due to the action of siphon tube 64, substantially all of the water therein is transferred in a short time to expandable reservoir 30. During this transfer, the air within reservoir 30 which would otherwise be trapped and inhibit the filling process is vented through aperture 32, tube 44 and vent opening 45. Thus, reservoir 30 fills with water.

As water transfers to reservoir 30, a slow outward flow takes places through outlet 40 and restrictive orifice 23. The rate of flow is substantially less than the rate of transfer from reservoir 60 to reservoir 30. Thus water accumulates rapidly within reservoir 30. The accumulated water within reservoir 30 causes flexible wall 42 to bulge or flex outwardly to the convex configuration shown in FIG. 3. The outward flexing of wall 42 activates switch 50 completing the electrical circuit between batteries 25 and sound unit 53. While any number of sound producing units may be used for sound unit 53 of the type known within the art, it has been found advantageous for purposes of realism to configure sound unit 53 so as to produce crying sounds typical of human infants. Thus, as expandable reservoir 30 continues to fill, simultaneous processes of crying sound emission by sound unit 53 and a wetting flow of liquid through orifice 23 occur. Thus, doll 10 realistically replicates the actions of an infant wetting its diaper or clothing and crying in response to the discomfort associated with such wetting activity. As expandable reservoir 30 is depleted by the flow out through orifice 23, the pressure upon flexible wall 42 diminishes and switch 50 returns to its open circuit condition whereby the crying action ceases. It should be noted that it may in some applications be desirable to configure switch 50 and sound unit 53 in an operative manner in which sound unit 53 continues to produce crying sounds for a predetermined time interval following the depletion of expandable reservoir 30. By further alternative, sound unit 53 may be configured so as to require a reset action in order to terminate the production of crying sounds once initiated by the expansion of flexible wall 42.

Figure 2:
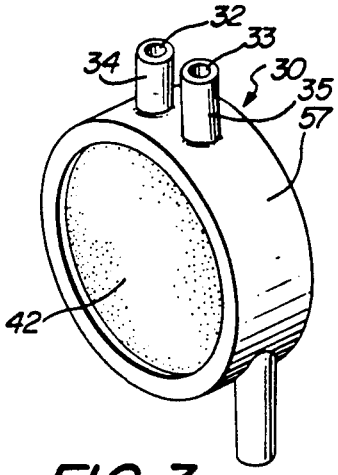
FIG. 2 sets forth a perspective view of the expandable bladder portion of the present invention wetting and crying doll in the empty configuration.
Figure 3:
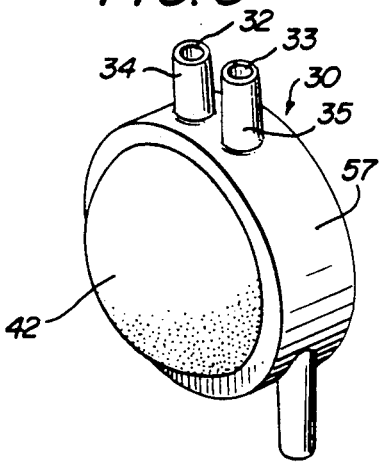
FIG. 3 sets forth a perspective view of the expandable bladder of FIG. 2 in the filled configuration.

FIGS. 2 and 3 set forth perspective views of expandable reservoir 30. Specifically, FIG. 2 sets forth expandable reservoir 30 having a generally cylindrical wall 57 defining a pair of upwardly extending fittings 34 and 35. Fittings 34 and 35 define apertures 32 and 33 respectively. Expandable reservoir 30 further defines a flexible wall 42 and a downwardly extending fitting 41. Fitting 41 defines an outlet aperture 40.

In the configuration shown in FIG. 2, expandable reservoir 30 is shown in its empty or nearly empty configuration. As such, flexible wall 42 which is preferably formed of a resilient rubber or plastic material or the like remains unflexed in a generally planar configuration. With temporary reference to FIG. 1, it will be appreciated that, with flexible wall 42 in its planar position, switch 50 remains in its unactuated position.

FIG. 3 shows expandable reservoir 30 in its filled or nearly filled configuration. As can be seen by comparison of FIGS. 2 and 3, the presence of liquid within expandable reservoir 30 causes flexible wall 42 to bulge or flex outwardly to assume the convex shape shown in FIG. 3. Again, with temporary reference to FIG. 1, it will be appreciated that the outward bulging or flexing of wall 42 causes switch 50 to be actuated producing the above-described operation.

Figure 4:
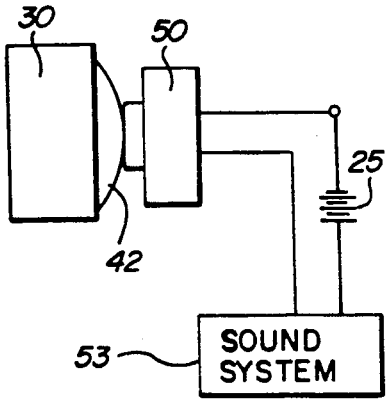
FIG. 4 sets forth a block diagram of the crying function of the present invention wetting and crying doll.

FIG. 4 sets forth a block diagram of the sound producing system of the present invention. Expandable reservoir 30 having flexible wall 42 are shown positioned in contact with a switch 50 which may be constructed in accordance with conventional fabrication techniques. Thus, switch 50 responds to the force produced against switch 50 by expandable wall 42 to complete the electrical connection within switch 50 in accordance with conventional fabrication techniques. Switch 50 is coupled to sound system 53 and to batteries 25. Thus, with expandable reservoir 30 empty or nearly empty, flexible wall 42 assumes the planar configuration described above. In such case, switch 50 remains in its open circuit condition and the battery circuit of sound system 53 is interrupted. As a result, sound system 53 does not produce the above-described crying sounds. As expandable reservoir 30 fills, flexible wall 42 bulges outwardly activating switch 50 and completing the electrical circuit for sound system 53. Thus, sound system 53 begins producing the above-described crying sounds. Sound system 53 continues in operation so long as switch 50 remains closed due to the pressure applied by expandable wall 42. Once reservoir 30 is emptied, switch 50 again opens interrupting the battery circuit of sound system 53 and terminating the production of crying sounds. Once again, it will be apparent to those skilled in the art that variations of the basic operation of the present invention system may be implemented without departing from the spirit and scope of the present invention. For example, sound system 53 and switch 50 may be configured such that sound system 53 continues to operate for a predetermined time interval following the opening of switch 50. Similarly, sound system 53 may be configured to continue operation once triggered until a standard reset or interrupt button is manually pushed by the user.

Figure 5:
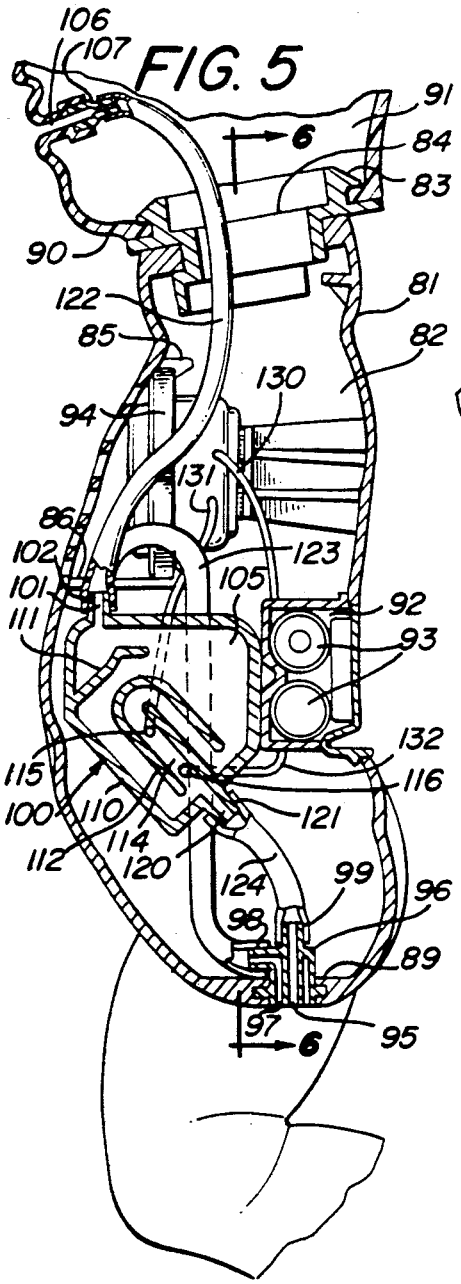
FIG. 5 sets forth a section view of an alternate embodiment of the present invention wetting and crying doll.
Figure 6:
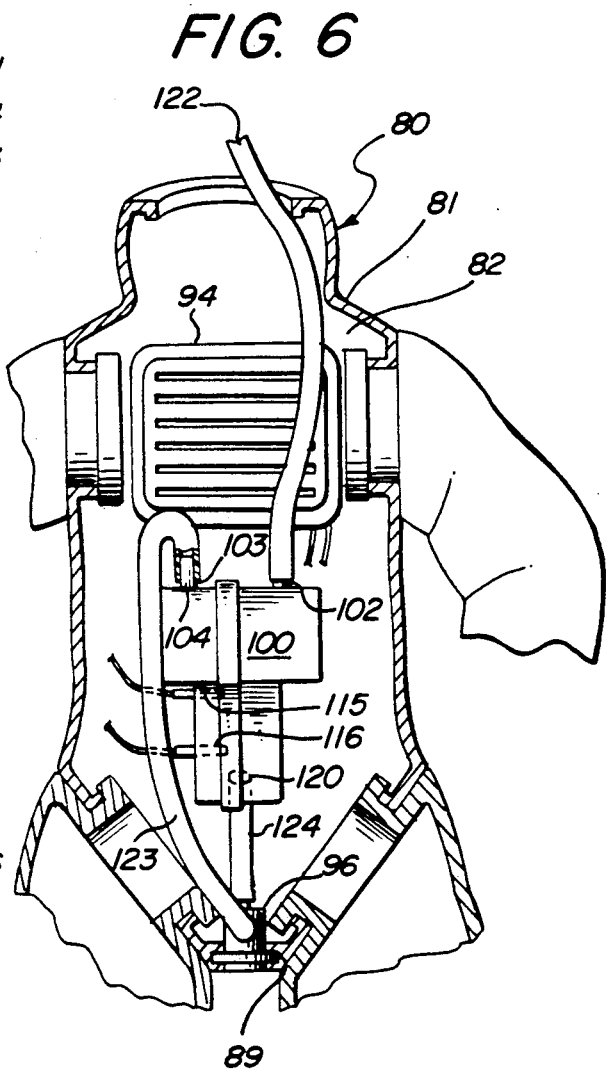
FIG. 6 sets forth a section view of the present invention wetting and crying doll taken along section lines 6—6 in FIG. 1.

FIGS. 5 and 6 set forth an alternate embodiment of the present invention doll. Specifically, FIG. 5 sets forth a section view of a doll constructed in accordance with the present invention and generally referenced by numeral 80. Doll 80 includes a head 90 defining an interior cavity 91 and a torso 81 defining an interior cavity 82. Head 90 defines a mouth opening 106 having a fitting 107 extending inwardly therefrom. A neck coupler 83 defines an interior passage 84 and provides attachment between torso 81 and head 90. Torso 81 further defines a battery compartment 92 supporting a plurality of conventional batteries 93. Torso 81 further defines an aperture 89 receiving and supporting a fitting 96 which in turn defines orifices 95 and 97. Fitting 96 further defines a fitting 98 coupled to orifice 97 and a fitting 99 coupled to orifice 95.

A water reservoir 100 is supported within interior cavity 82 by conventional support means not shown. Reservoir 100 defines an exterior wall 110 having an aperture 101 and a fitting 102 defined therein. Wall 110 further defines a downwardly facing aperture 120 having a fitting 121 extending downwardly therefrom. Reservoir 100 defines an interior cavity 105 and an interior baffle 111. A generally U-shaped inner wall 112 and a planar inner wall 113 cooperate to form a generally U-shaped siphon passage 114. A pair of electrical contacts 115 and 116 are supported within siphon passage 114.

A hollow tube 122 couples fitting 102 of reservoir 100 to fitting 107 of head 90. A hollow tube 123 couples fitting 103 of reservoir 100 to fitting 98 of fitting 96. A hollow tube 124 is coupled between fittings 121 and 99.

A sound producing unit 94, constructed in accordance with conventional fabrication techniques, is supported within interior cavity 82 by a pair of support brackets 85 and 86. A pair of connecting wires 130 and 131 couple sound unit 94 to batteries 93 and contact 115 respectively. A connecting wire 132 couples contact 116 to the remaining terminal of batteries 93. Thus, an electrical circuit is formed between batteries 93, sound unit 94 and electrical contacts 115 and 116.

In operation, with reservoir 100 empty, no flow of water is provided through aperture 120 to 124 and orifice 95. Thus, no wetting action takes place. In addition, the absence of water within reservoir 100 interrupts the electrical current flow between contacts 115 and 116. Thus, sound unit 94 is inactive and no crying sounds are produced. To begin operation of doll 80, a quantity of liquid (usually water) is introduced through opening 106 and caused to flow through tube 122 and into reservoir 100 through aperture 101. In its preferred form, the introduction of liquid in the system of doll 80 is performed using a simulated bottle such as bottle 16 (shown in FIG. 1) and with doll 80 in a horizontal or nearly horizontal position. Thus, as liquid flows downwardly through tube 122 into reservoir 100, baffle 111 diverts the liquid flow causing an accumulation of liquid within reservoir 100 in the area bounded by interior wall 113 and a portion of outer wall 110. Because interior wall 113 is continuous with outer wall 110 and because wall 113 separates the accumulating water from aperture 120 during the initial filling of reservoir 100, no water flow is produced outwardly through aperture 120 to 124 and orifice 95. Thus, while water continues to be introduced into doll 80, no wetting action takes place. As the water level within the bounded area of reservoir 100 rises within siphon passage 114, water continues to accumulate within reservoir 100 without an outward flow. However, once the water level within the bounded area of reservoir 100 exceeds the extension of interior wall 113, the siphon action of siphon passage 114 causes water to rapidly flow into the remainder of reservoir 100 including aperture 120. At this point, water begins escaping through aperture 120 to 124 and outwardly through orifice 95. Orifice 95 is substantially smaller in diameter than tube 124 and aperture 120 and thus a limited restricted flow results. The presence of water between electrical contacts 115 and 116 completes the electrical circuit for sound unit 94 causing the sound unit to produce crying sounds.

Thus, the operation of doll 80 is similar to the operation of doll 10 shown in FIGS. 1 through 4 in that the initial introduction of water does not produce an immediate wetting action. Rather, the wetting action is delayed until a predetermined quantity of water has been introduced into the doll. Concurrently, the production of crying sounds is delayed until water begins flowing in the simulated wetting action to more realistically replicate the activity anticipated of a human infant. The siphon action provided by siphon passage 114 provides a rapid flow of water once the siphon level is exceeded and effectively transfers the liquid rapidly to the portion of water reservoir 100 which ultimately flows out through wetting action. Once the liquid level within water reservoir 100 decreases beneath contact 115, the electrical connection between contacts 115 and 116 is interrupted and sound unit 94 ceases the production of crying sounds.

FIG. 6 sets forth a section view of the embodiment of the present invention doll taken along section lines 6—6 in FIG. 5. Thus, doll 80 includes a torso 81 defining an interior cavity 82. A sound unit 94 is supported within interior cavity 82. Torso 81 further defines an aperture 89 supporting a combination fitting 96. Fitting 96 includes orifices 95 and 97 (seen in FIG. 5) coupled to hollow tubes 124 and 123 respectively. A water reservoir 100 includes a fitting 102 coupled to a mouth opening 106 (seen in FIG. 5) by a hollow tube 122). Reservoir 100 further includes a fitting 103 coupled to a tube 123 which in turn is coupled to fitting 96. A pair of electrical contacts 115 and 116 are supported within the interior of water reservoir 100. For purposes of illustration clarity, battery compartment 92 and batteries 93 are not shown in FIG. 6. Reservoir 100 further includes a downwardly facing aperture 120 coupled to fitting 96 by a tube 124.

It should be noted that fitting 96, tube 123 and fitting 103 cooperate to provide an air vent for reservoir 100 through openings 104 in reservoir 100 and vent orifice 97 in fitting 96 (seen in FIG. 5). Thus, during the above-described filling of reservoir 100, air within reservoir 100 which would otherwise be trapped, is vented outwardly through tube 123.

What has been shown is a doll having delayed wetting and crying action which uses an internal siphon to provide a delayed transfer of introduced liquid between a first liquid retaining area and a second liquid retaining area. The first liquid retaining area is sealed or isolated from the second area except for the siphon tube connection until a predetermined water level is reached. The operation of the sound producing system within the present invention doll is similarly delayed until the occurrence of the wetting function. As a result, a realistic simulation of wetting and crying action similar to human infants is produced.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll simulating wetting and crying actions for transferring a liquid in a realistic flow rate, said doll comprising:

a doll body having an interior cavity, a mouth opening, and a lower body opening;

sound means for producing crying sounds;

a first liquid receiving and retaining reservoir coupled to said mouth opening;

a second liquid receiving and retaining reservoir having discharge means coupled to said lower body opening for producing a flow of liquid from said second reservoir which is independent of the flow between reservoirs;

siphon means coupling said first and second reservoirs, said siphon means being inoperative until the liquid within said first reservoir exceeds a predetermined level said siphon means acting to effectively empty said first reservoir to said second reservoir upon actuation; and switch means responsive to the transfer of liquid from said first reservoir to said second reservoir enabling said sound means.

2. A doll as set forth in claim 1 wherein said first and second reservoirs are vented.

3. A doll as set forth in claim 1 wherein said doll body defines head and torso cavities connected by a neck passage.

4. A doll as set forth in claim 3 wherein said first reservoir is supported within said head cavity and said second reservoir is supported within said torso cavity.

5. A doll as set forth in claim 4 wherein said siphon means are supported within said first reservoir and wherein said doll includes a hollow tube coupling said siphon means to said second reservoir.

6. A doll as set forth in claim 5 wherein said second reservoir includes an expandable portion which expands when said second reservoir receives liquid and wherein said switch means include a switch having an actuator moved by said expandable portion.

7. A doll as set forth in claim 6 wherein said expandable portion of said second reservoir includes a flexible wall.

8. A doll simulating wetting and crying actions for transferring a liquid in a realistic flow rate, said doll comprising:

a doll body having an interior cavity, a mouth opening, and a lower body opening;

sound means for producing crying sounds;

a water tank supported within said interior cavity and wherein first and second reservoirs are enclosed with said first reservoir coupled to said mouth;

said second reservoir having a discharge means coupled to said lower body opening for producing a flow of liquid from said reservoir which is independent of flow between reservoirs;

siphon means coupled to said second reservoir being inoperative until liquid within said second reservoir exceed a predetermined level whereupon said siphon means acts to effectively empty said second reservoir to said lower body opening; and switch means responsive to the transfer of liquid through said siphon means thereby enabling said sound means.

9. A doll as set forth in claim 8 wherein said water tank defines a first interior wall and first and second reservoirs are separated by said first interior wall.

10. A doll as set forth in claim 9 wherein said siphon means includes a second interior wall forming a generally U-shaped member about said first interior wall forming a siphon passage therebetween.

11. A doll as set forth in claim 10 wherein said switch means include a pair of electrical contacts disposed within said siphon passage.

12. A doll as set forth in claim 11 wherein said electrical contacts include electrodes supported in a spaced-apart arrangement.

* * * * *